US006422501B1

(12) United States Patent
Hertel et al.

(10) Patent No.: US 6,422,501 B1
(45) Date of Patent: Jul. 23, 2002

(54) CORE INFEED APPARATUS FOR WINDER

(75) Inventors: James E. Hertel, Green Bay; Thomas J. Daul, Oneida; Steve Jansen, De Pere, all of WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 09/723,027

(22) Filed: Nov. 27, 2000

(51) Int. Cl.[7] ..... B65H 19/28; B65H 19/22

(52) U.S. Cl. ..... 242/532.3; 242/532.4; 242/533

(58) Field of Search ..... 242/532.3, 532.4, 242/533

(56) References Cited

U.S. PATENT DOCUMENTS

RE28,353 E 3/1975 Nystrand et al.
4,723,724 A 2/1988 Bradley
4,828,195 A 5/1989 Hertel et al.
4,909,452 A 3/1990 Hertel et al.
5,104,055 A 4/1992 Buxton
5,370,335 A 12/1994 Vigneau
RE35,304 E 7/1996 Biagiotti
6,056,229 A 5/2000 Blume et al.

*Primary Examiner*—Donald P. Walsh
*Assistant Examiner*—Jonathan R. Miller

(57) ABSTRACT

A core infeed apparatus for a surface winder moves an elongated core axially into the winder while an axial line of glue is applied to the core. The core is moved into a space between a pair of rotatable core guides. One of the core guides is rotatable away from the core while the other core guide rotates the core toward a core inserter. The core is transferred to the core inserter, and the core inserter rotates to move the core toward the winding rolls of the rewinder. The position of the glue line is accurately maintained as the core moves to its various positions.

14 Claims, 9 Drawing Sheets

CORE INFEED APPARATUS FOR WINDER

BACKGROUND

This invention relates to a surface winder for winding a web into rolls or logs. More particularly, the invention relates to an infeed mechanism for feeding cores axially into the winder and for moving the cores toward the winding rolls of the winder.

Winders, also called rewinders, are used to convert large parent rolls of paper into retail sized rolls of bathroom tissue and paper towels. Two types of rewinders are commonly used—center rewinders and surface rewinders. Center rewinders are described, for example, in U.S. Reissue Pat. No. 28,353 and wind the web on a core which is rotated by a mandrel. Surface rewinders are described, for example, in U.S. Pat. Nos. 4,723,724 and 5,104,055 and wind the web on a core which is rotated by a three roll cradle.

Before the web is wound on a core, glue is applied to the core so that the leading edge of the web adheres to the core to begin the winding process. It is important to be able to maintain the position of the glue accurately relative to the leading edge of the web so that the web is transferred to the core without undesirable wrinkling or folding of the web.

It is also desirable to apply the glue to the core and to position the core to begin the winding process as quickly as possible so that the core infeed process does not limit the recycle speed of the winder.

SUMMARY OF THE INVENTION

The invention provides a core infeed mechanism which feeds cores in an axial direction into the winder while a stripe of glue is applied to each core. The position of the glue stripe is accurately maintained by the engagement between the core and the core drive mechanism and by opposed core guides which hold the core as the core is inserted. After the core is inserted between the core guides, one of the core guides rotates out of engagement with the core, and the other core guide rotates the core into engagement with a rotatable core inserter. The core inserter rotates the core to the space between a first winding roll and a stationary plate to begin the winding process. The core is inserted into the space with the glue line accurately positioned relative to the leading end of the web.

The cores are driven axially into the space between the core guides at high speed, and friction between the core guides and the cores maintains the position of the glue stripe and assists in controlling core rebound at the end of core travel. Core rebound may also be restrained by a one-way ratchet rollers on the core guides. The separation of the axial core infeed step from the rotary core insertion step enables high cycle rates to be obtained.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
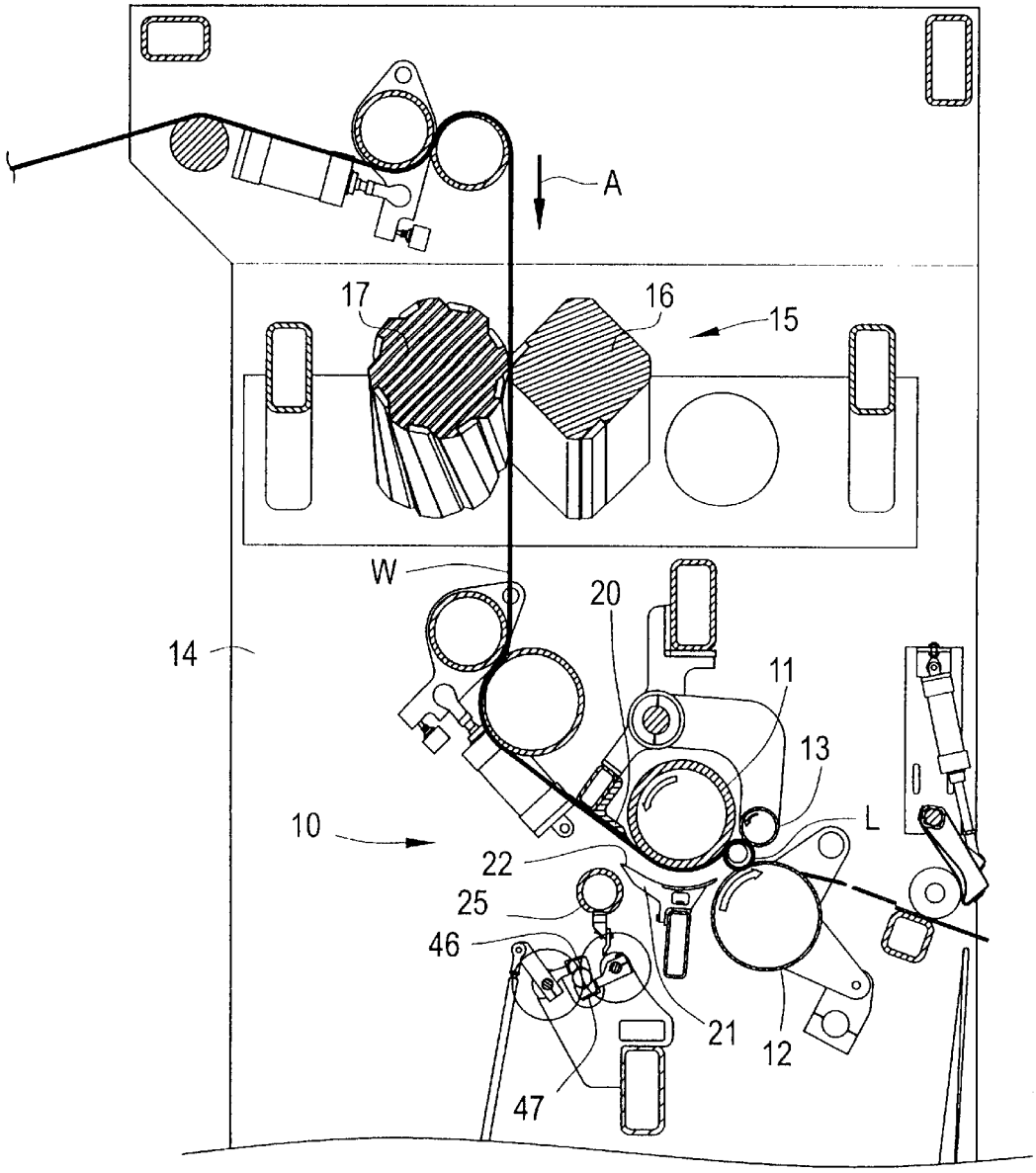
FIG. 1 is a fragmentary side elevational view of a surface winder which includes a core infeed apparatus in accordance with the invention.

FIG. 1 illustrates a surface winder or rewinder 10 which is generally described in U.S. Pat. No. 6,056,229. The particular rewinder illustrated is described in the United States patent application entitled "Apparatus and Method for Applying Glue to Cores, Ser. No. 09/559,865, filed Apr. 26, 2000, which is incorporated herein by reference.

The rewinder includes a conventional three roll winding cradle which includes a first or upper winding roll 11, a second or lower winding roll 12, and a rider roll 13. The rolls are mounted in a frame 14 for rotation in the direction of the arrows to wind a web W on a hollow cardboard core C to form a log L of convolutely wound paper such as bathroom tissue or paper toweling.

The second winding roll 12 can be movably mounted on the rewinder so that the roll can move toward and away from the first winding roll as described in U.S. Pat. Nos. 4,828,195 and 4,909,452. The second winding roll can also have a variable speed profile as described in U.S. Pat. No. 5,370,335.

The rider roll 13 is pivotably mounted so that it moves away from the second roll as the winding log builds.

The web is advanced in a downstream direction as indicated by the arrow A and is preferably transversely perforated along longitudinally spaced lines of perforation to form individual sheets. In the particular embodiment illustrated, a perforator assembly 15 includes an anvil 16 and a rotating perforating roll 17.

Figure 4:
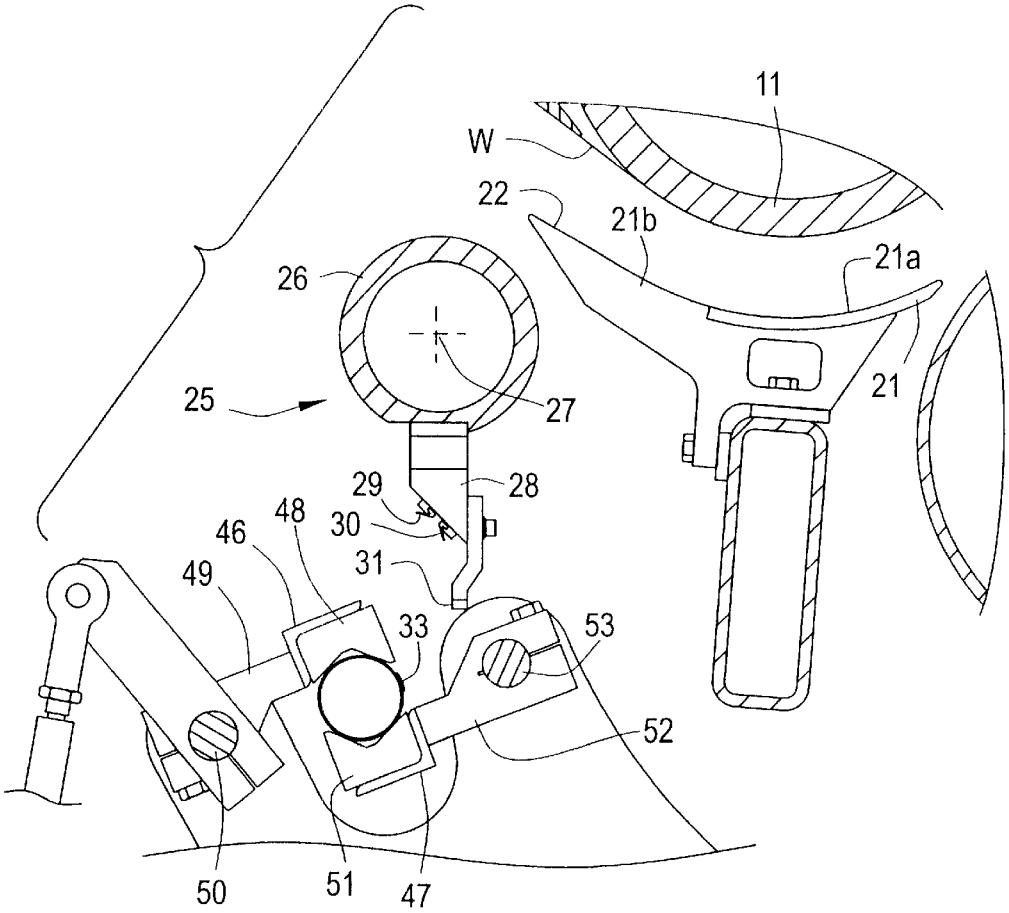
FIG. 4 is an enlarged fragmentary view of a portion of FIG. 1.

Before the web reaches the first winding roll 11, it travels over a stationary pinch bar 20 which is mounted adjacent the first winding roll. A stationary plate 21 (also referred to as a transfer plate or dead plate) is mounted below the first winding roll 11 upstream of the second winding roll 12. The upstream end 22 of the stationary plate is spaced from the first winding roll a distance slightly greater than the diameter of the cores C. The spacing between the remainder of the stationary plate and the first winding roll is slightly less than the diameter of the cores so that the cores will be compressed slightly and will be rolled along the stationary plate by the rotating winding roll 11. Referring to FIG. 4, the stationary plate includes a solid portion 21*a* which extends for the axial length of the rewinder and axially spaced fingers 21*b*.

A core inserter 25 is mounted on a shaft 26 (FIG. 4) which is rotatably mounted on the frame 14 for rotation about an axis 27. The core inserter includes a plurality of axially spaced arms 28 which extend radially outwardly from the shaft 26. Each arm is provided with a series of urethane vacuum cups 29. Vacuum ports 30 in the cups communicate with a source of vacuum for holding a core in the cups by suction. Compressible and resilient pinch pads 31 are mounted on the ends of the arms 28. The pinch pads pinch the web against the stationary pinch bar 20 (FIG. 1) as the core inserter rotates.

Figure 11:
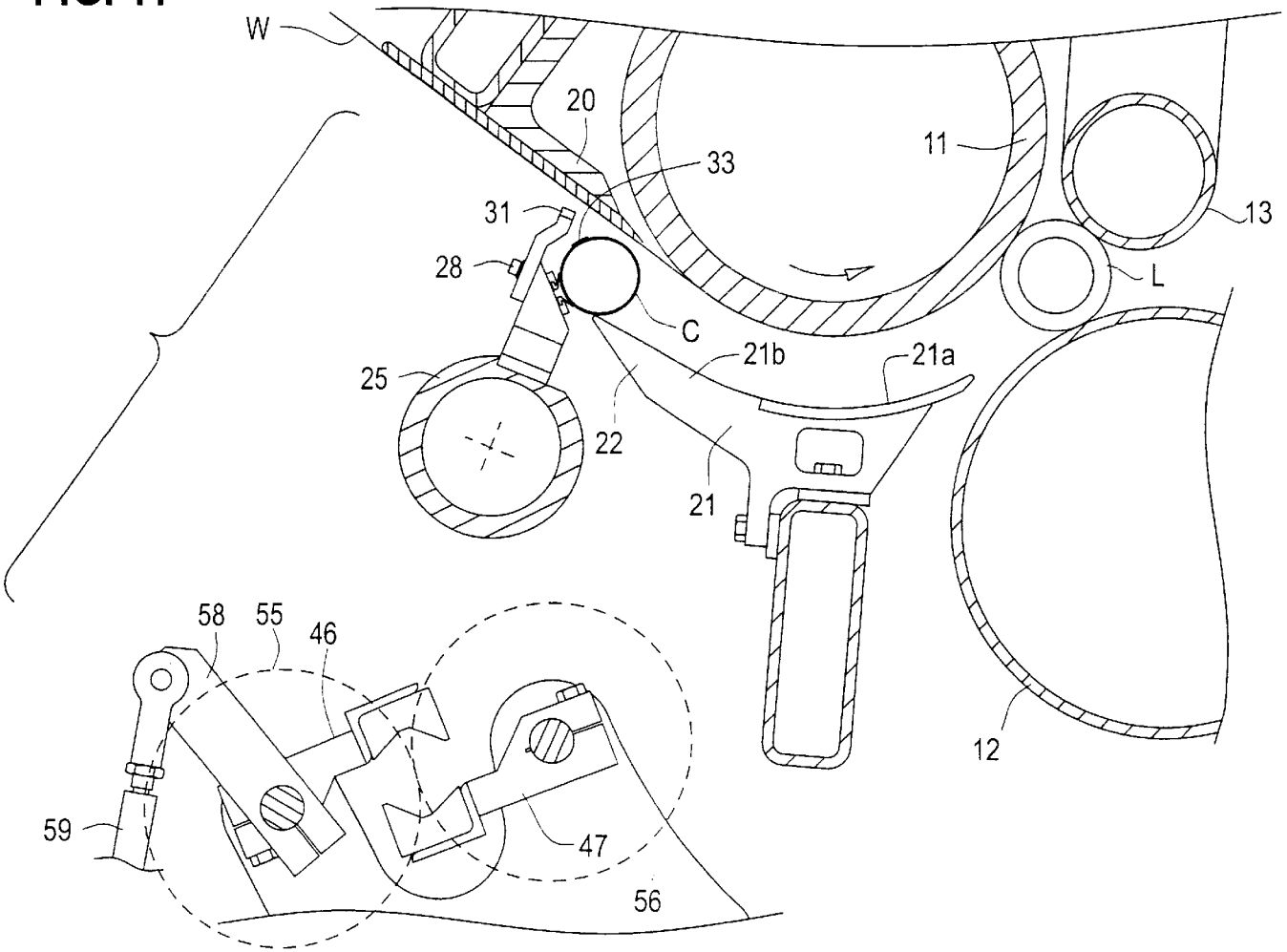
FIG. 11 illustrates the rotary core inserter inserting the core into the space between a first winding roll and a stationary plate.

The details of the winding cycle are described in U.S. Pat. No. 6,056,229. Referring to FIG. 11, the core inserter 25 rotates clockwise to move a core C into the space between the upstream end 22 of the stationary plate 21 and the first winding roll 11. In FIG. 11 the core is close to the web but does not pinch the web. The pinch pads 31 have not engaged the web, and the web continues to be wound on the log L.

As the core inserter 25 continues to rotate, the pinch pads 31 pinch the web against the stationary pinch bar 20 and cause the web to sever along the downstream perforation line which is closest to the core. The arms 28 on the core inserter push the core into contact with the first winding roll 11 and the stationary plate 21, and the rotating winding roll causes the core to roll over the stationary plate. An axial glue stripe 33 on the core contacts the severed web, and the web begins to wind on the core as the core rolls over the stationary plate. The axially spaced arms 28 pass through the spaces between the axially spaced fingers 21*b* as the core inserter rotates clockwise. When the core and the winding log reach the second winding roll 12, the log is wound between the first and second winding rolls and is eventually contacted by the rider roll 13.

Figure 2:
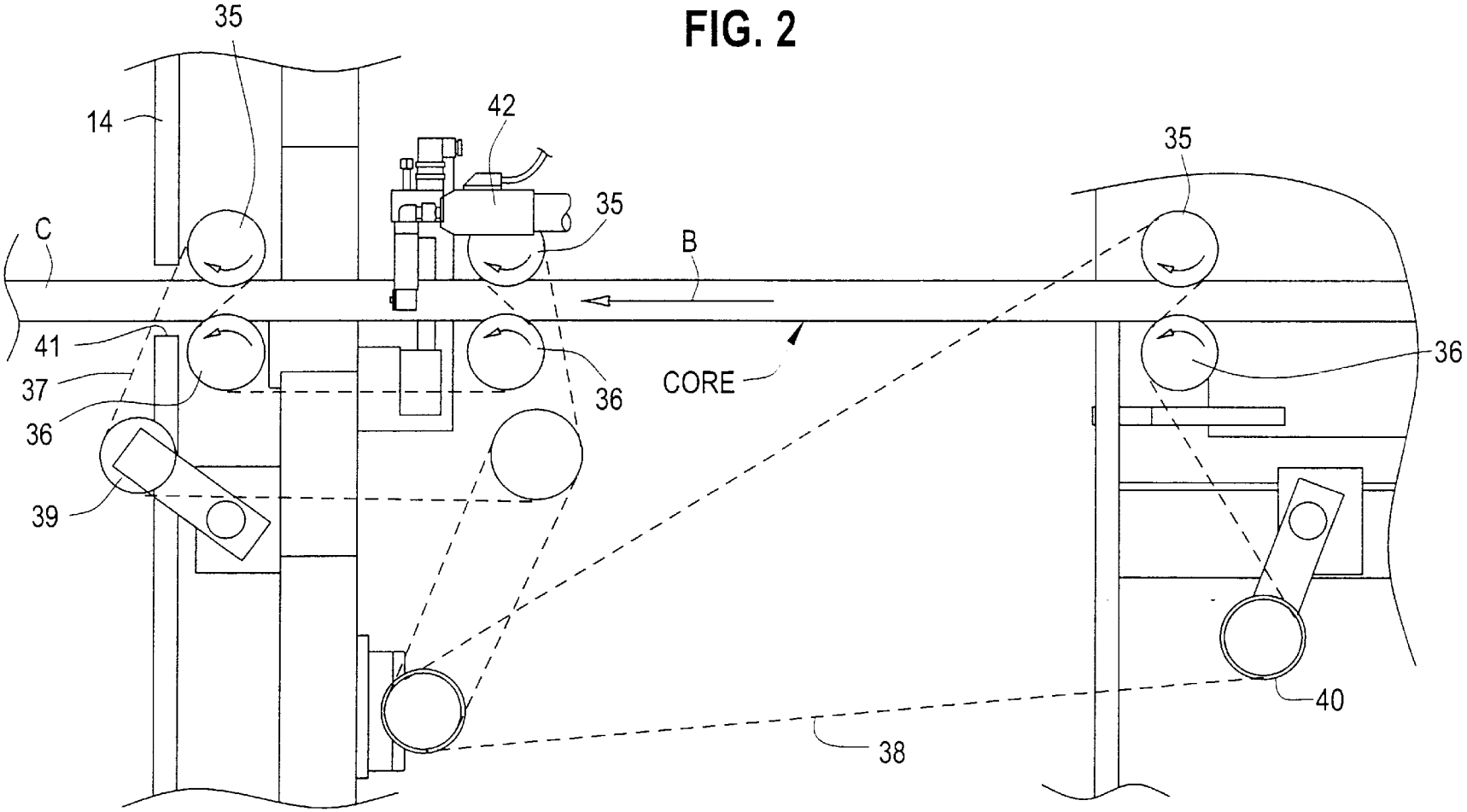
FIG. 2 is an elevational view of the glue applicator and the axial drive mechanism for the core.

Referring to FIG. 2, cores are fed axially into the rewinder by a plurality of pairs of upper and lower core drive wheels 35 and 36. The drive wheels are driven by belts 37 and 38. Belt tension is controlled by belt tightener wheels 39 and 40.

The cores are fed to the drive wheels from a conventional core magazine (not shown) by a core pusher. The cores are driven in the direction of arrow B through an opening 41 in the frame 14 of the rewinder. A glue applicator 42 applies an axially extending stripe of glue on the core as the core moves past the glue applicator. In the particular embodiment illustrated the glue applicator includes a spray nozzle 43 (FIG. 3) which sprays heated glue or cold adhesive onto the core. Other types of glue applicators can also be used for applying a continuous or intermittent line of glue to the core.

Figure 3:
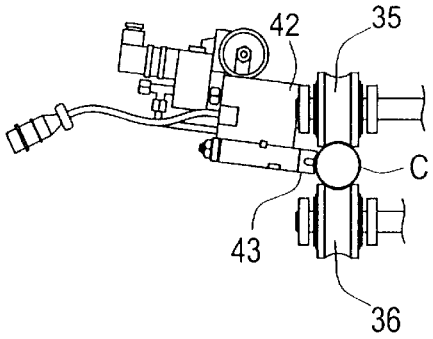
FIG. 3 is a fragmentary end view of the glue applicator.

In FIG. 3 the glue stripe is applied to the core at 15° above the horizontal centerline. The position of the glue stripe is accurately maintained as the core moves axially by the frictional forces between the core and the drive wheels.

Figure 14:
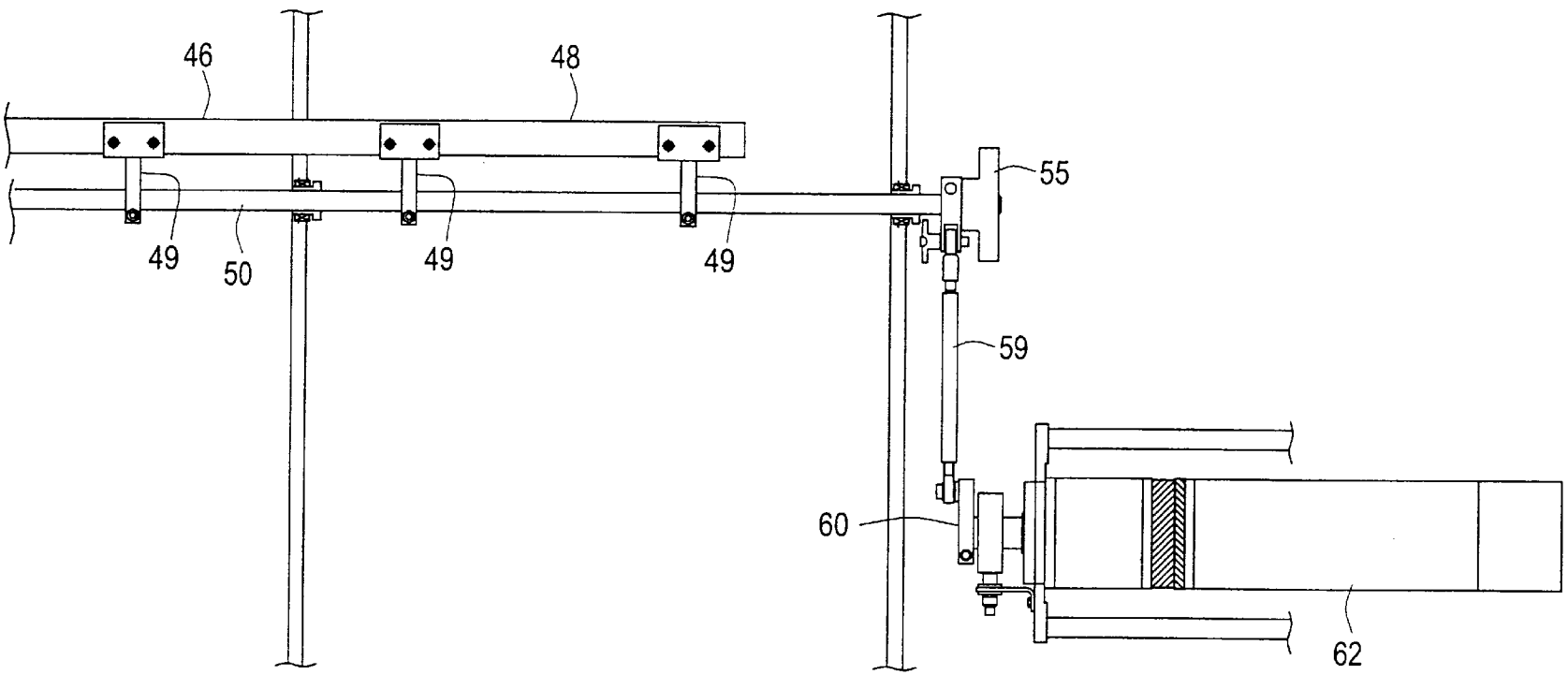
FIG. 14 is a fragmentary view showing the drive for rotating the core guides.

As the core moves axially into the rewinder, the core is inserted into the space between a pair of core guides 46 and 47 (FIG. 4). The core guide 46 includes a plastic channel 48 which is supported by a plurality of axially spaced arms 49 (see also FIG. 14). The arms are clamped onto a shaft 50 which is rotatably mounted on the frame of the rewinder.

The core guide 47 similarly includes a plastic channel 51 which is supported by arms 52 and a rotatable shaft 53. Each of the channels 48 and 51 include a generally V-shaped surface for engaging the core.

Figure 6:
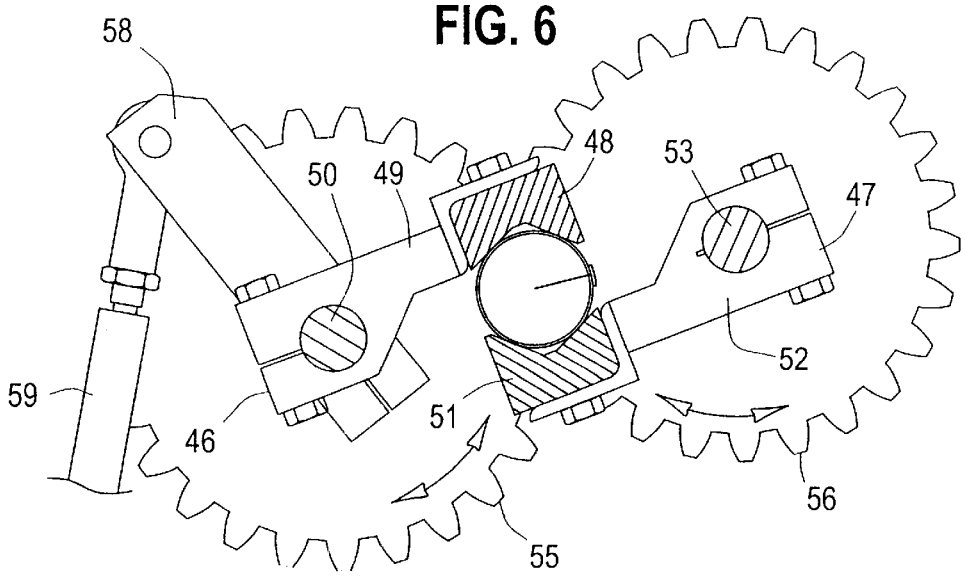
FIG. 6 illustrates the gears which rotate the core guides.
Figure 7:
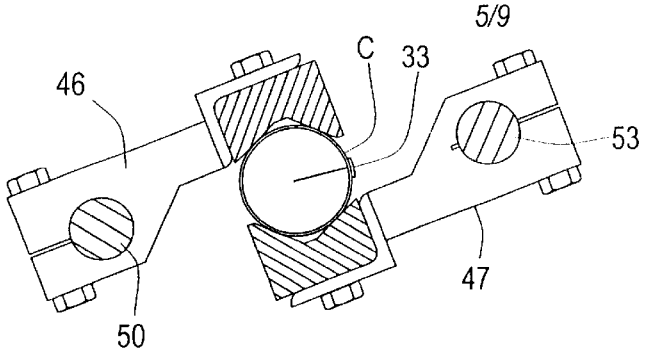
FIGS. 7–10 illustrate the sequence of movement of the core guides.
Figure 8:
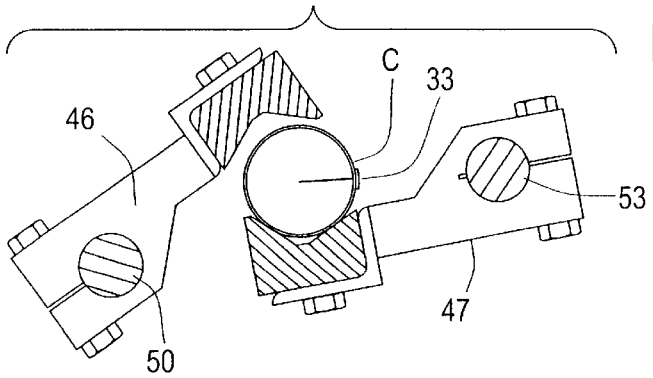
Figure 9:
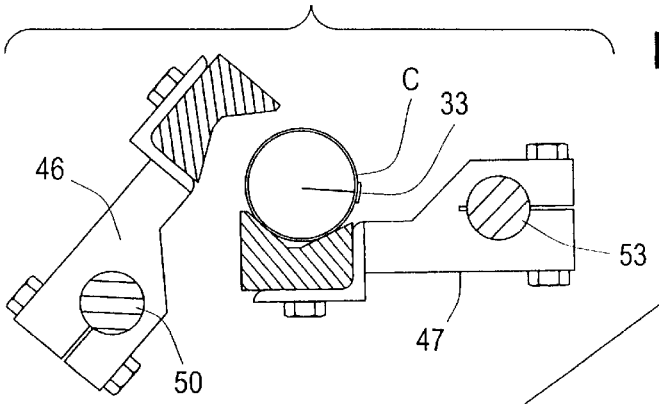

Referring to FIG. 6, gears 55 and 56 are mounted on the shafts 50 and 53, respectively, so that the shafts rotate together. Gear 55 has a smaller diameter than gear 56 so that shaft 50 rotates faster than shaft 53. The ratio of the gears is preferably 1.20:1 to 1.50:1.

Figure 12:
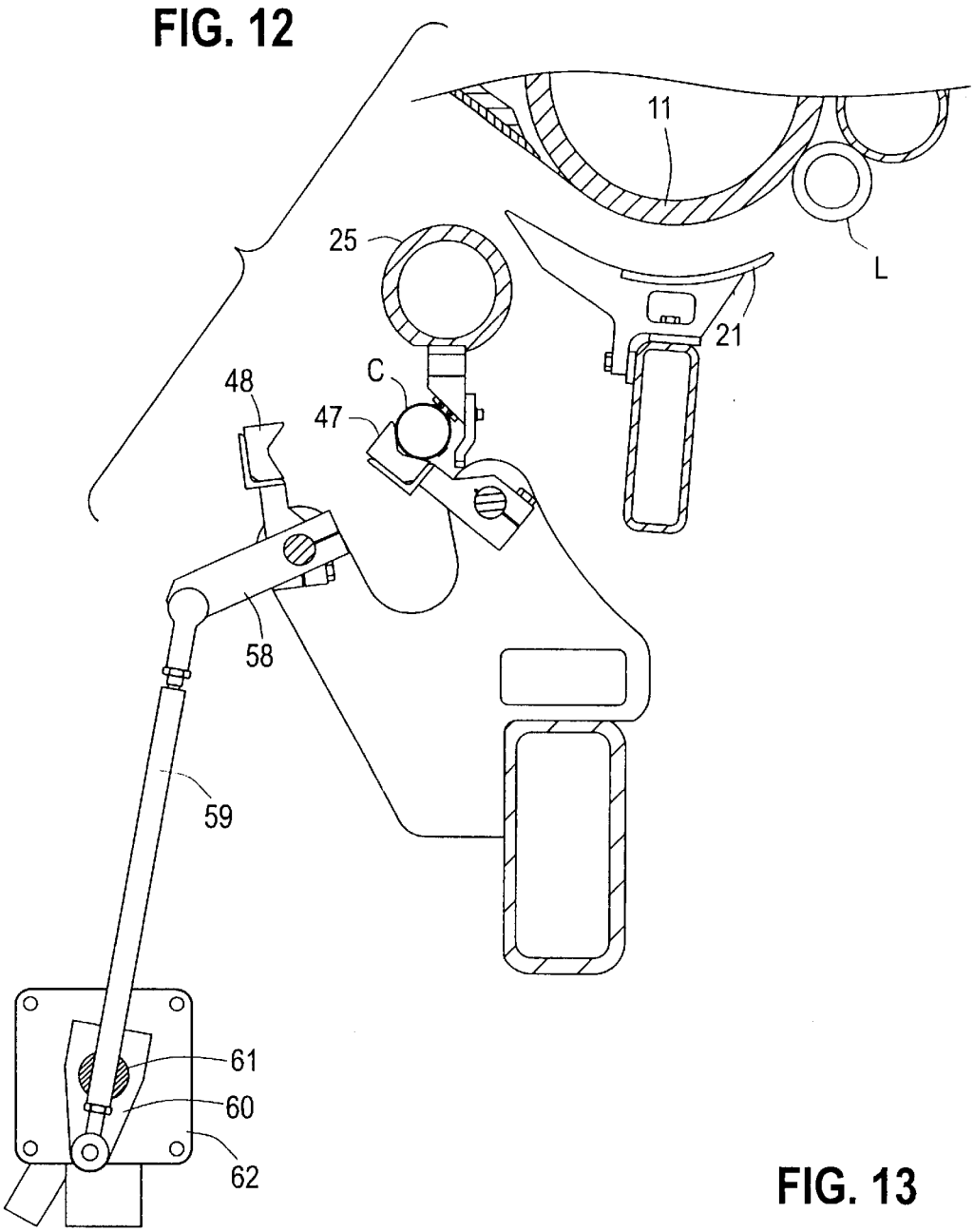
FIG. 12 is a view similar to FIG. 5 showing the crank arm for rotating the core guides.

The shafts 50 and 53 are rotated by a crank arm 58 which is clamped onto shaft 50. The crank arm is reciprocated by a connecting rod 59 whose lower end is connected to a rotatable crank arm 60 (FIG. 12). The crank arm 60 is rotatable by the drive shaft 61 of a servo motor 62.

Figure 13:
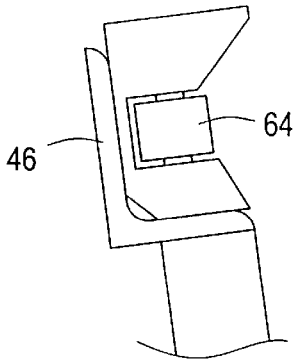
FIG. 13 is an enlarged fragmentary view of one of the core guides.

Referring to FIG. 13, one or both of the core guides 46 and 47 include one or more ratchet rollers 64. The ratchet rollers are provided with a high friction surface for engaging the core. The ratchet rollers are free to rotate in the direction in which the core is axially advanced but are prevented from rotating in the opposite direction.

The core is driven by the drive wheels 35 and 36 into the space between the core guides at a high speed. For example, a 120 inch long core can be inserted between the core guides in about one second (axial feeding speed of about 120 inches per second).

The core guides are positioned as in FIG. 4 as the core is inserted into the space between the core guides. The space between the core guides is less than the diameter of the core, for example, about 1/32 to 1/16 inch less than the core diameter. The core guides therefore frictionally engage the core, maintain the position of the glue stripe, and slow the core down as it advances. At the end of the core travel, the core hits a stop plate on the rewinder. The core is prevented from rebounding from the stop plate to any significant degree by the frictional engagement with the core guides and by the ratchet rollers 64.

FIG. 4 illustrates the position of the axial glue stripe 33 on the core C after insertion into the core guides. The glue stripe is maintained in the same position (15° above the horizontal centerline) as when the glue stripe was applied.

The winding cycle of the rewinder is controlled by a microprocessor in a manner which is well known in the art. At the appropriate time during the cycle, the microprocessor signals the servo motor 62 (FIGS. 12 and 14) which controls the core guides 46 and 47. The drive shaft 61 of the servo motor makes one complete revolution, which rotates the crank arm 58 first counterclockwise and then clockwise.

Referring to FIGS. 6–10, the drive shaft 50 and the core guide 46 are initially rotated counterclockwise to move the core guide 46 out of the way of the core C. The drive shaft 53 and the core guide 47 are initially rotated clockwise, but at a slower speed in order to give the core guide 46 time to move out of the way. The position of the core C and the glue line 33 (also indicated by a radial line on the core) remains fixed relative to the core guide 47 as the core guide rotates.

Figure 5:
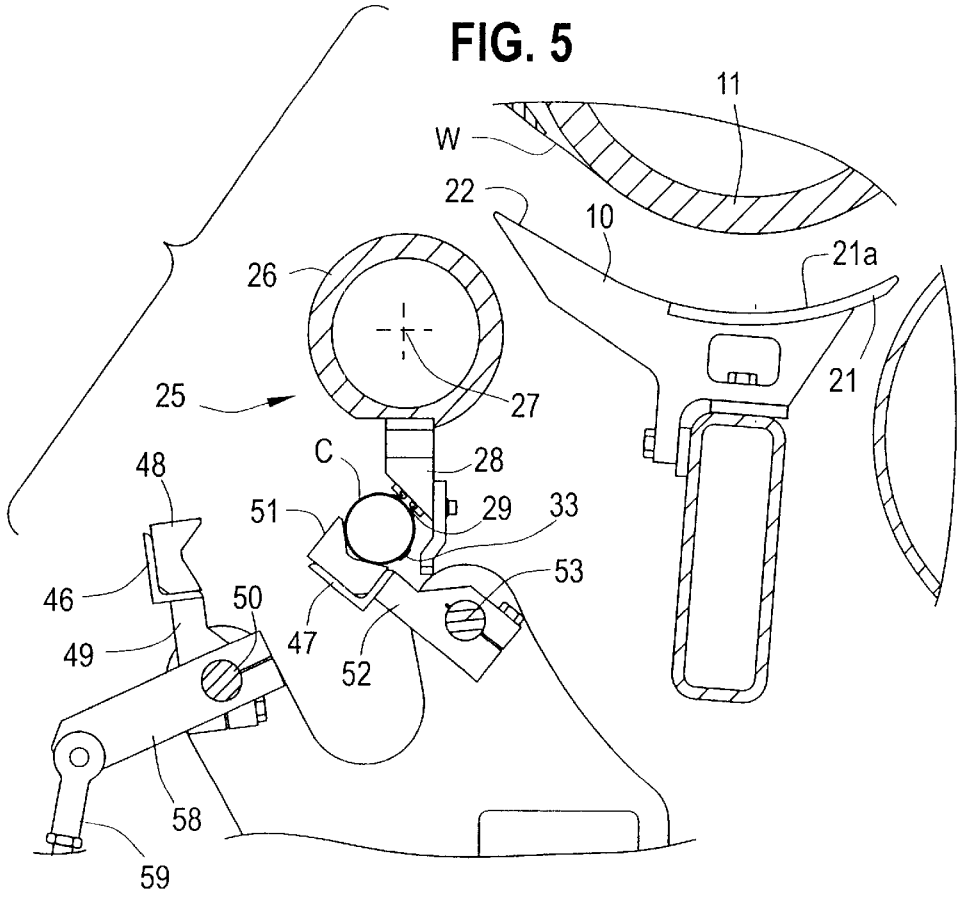
FIG. 5 is a view similar to FIG. 4 showing the core guides in their alternate positions.
Figure 10:
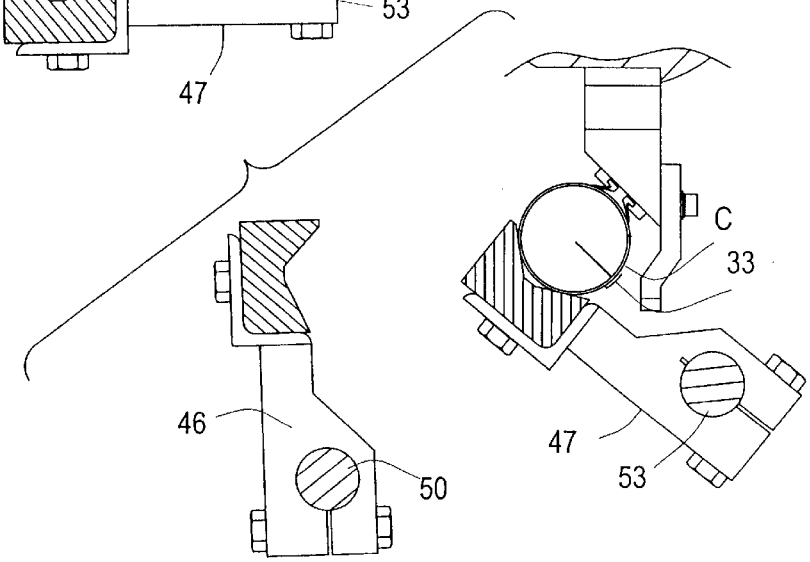

In FIGS. 5 and 10, the core guide 47 has rotated the core C into contact with the vacuum cups 29 on the rotary core inserter 25. The core guide 47 forces the core against the vacuum cups and straightens the core, which has a tendency to be crooked or bowed along its length. The core is retained on the core inserter by the vacuum cups. The microprocessor signals the core inserter to begin core insertion. As the crank arm 60 (FIG. 12) reaches the bottom of its travel, the core guides 46 and 47 are rotated back to their original positions.

The core inserter 25 is rotated by a servo motor which is controlled by the microprocessor of the rewinder. At the appropriate time during the winding cycle, the servo motor is actuated to rotate the core inserter clockwise (compare FIGS. 5 and 11).

FIG. 11 illustrates the position of the core inserter and the core just prior to the time that the pinch pads 31 pinch the web against the pinch bar 20. The position of the core relative to the core inserter remains fixed as the core inserter rotates, and the glue stripe 33 is downstream and slightly counterclockwise from the point where the core will initially contact the web. As the core inserter continues to rotate, the pinch pads 31 pinch and sever the web, and the core is inserted between the upper winding roll 11 and the stationary plate 21. The upper winding roll causes the core to roll over the stationary plate, and the core rotates clockwise for only a few degrees before the glue stripe 33 rotates into contact with the leading end portion of the severed web. The web adheres to the core and winds onto the core as the core rolls over the stationary plate.

Figure 15:
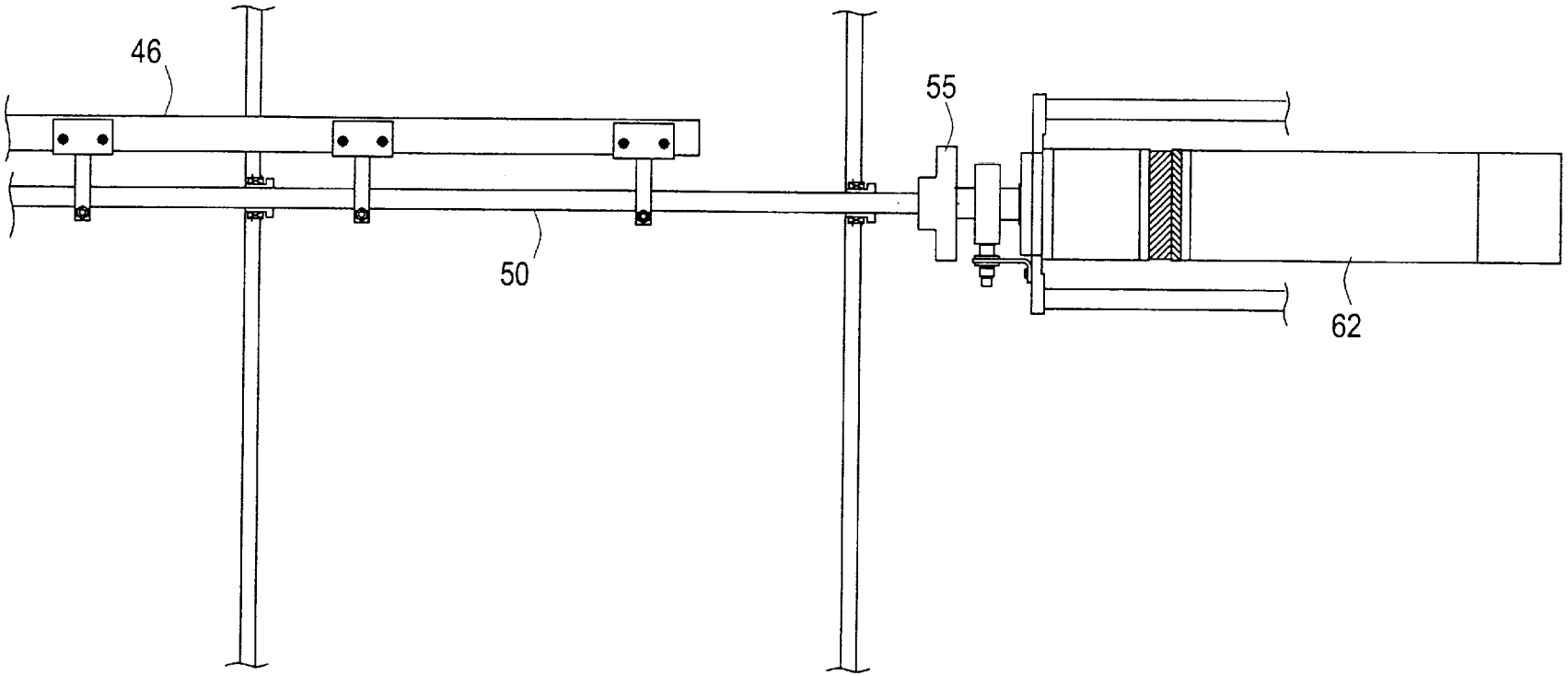
FIG. 15 is a view similar to FIG. 14 showing a direct drive connection to the core guide.

FIG. 15 illustrates an alternative embodiment in which the servo motor 62 is coupled directly to the shaft 50 of the core guide 46. The FIG. 15 embodiment eliminates the crank arms 58 and 60 and connecting rod 59 of FIG. 14.

The core infeed apparatus described herein provides precise alignment of the glue stripe relative to the pinch pads 31 and allows the rotary core inserter 25 to operate at high cycle rates. The precise alignment of the glue stripe is maintained by the frictional engagement between the core and the core drive wheels 35 and 36 and between the core and the core guides 46 and 47, by the rotary motion of the core guide 47 which transfers the core to the rotary core inserter 25, and by the vacuum grip between the core inserter and the core. High cycle rates are facilitated because the axial core infeed step is separated from the rotating core insertion step.

The choice of the length of the arms 49 and 52 of the core guides and the location of the pivot axis of the shaft 50 of the core guide 46 allow the glue applicator head to be positioned above the horizontal centerline of the core (15° above horizontal in FIG. 3). The arm length can range from 2.5 inches to 6.0 inches. The pivot axis of the shaft 50 is positioned outside of the path of travel of the rotary core inserter 25 and minimizes the angle the core guides 46 and 47 must pivot to between 45° and 75°.

An example of the high cycle rates which can be obtained with the axial core infeed apparatus follows:

Time for axial insertion of 120 inch core: 1 second

Time for core guide 47 to rotate core to rotary core inserter 25: 0.15 second Dwell of core guide 47 at core inserter: 0.1 second Return of core guides to approximately their original position: 0.15 second Final positioning of core guides: 0.1 second Total Time 1.5 seconds A cycle time of 1.5 seconds per core is equivalent to a rewinder cycle rate of 40 logs per minute. We believe that the invention will enable rewinder cycle rates of 50 logs per minute and higher.

The rotary core inserter 25 preferably inserts the core into the space between the upper winding roll 11 and the stationary plate 21 at a higher translational speed than the translational speed of the core as the core is rolled over the stationary plate by the upper winding roll. As the upper winding roll 11 rolls the core over the stationary plate 21, the translational speed of the core is one-half of web speed. The translational speed of the core during the insertion step can be 70% of web speed to enable the pinch pads 31 to sever the web and to permit the glue stripe 33 to pick up the web as soon as possible in order to minimize slack in the web. The translational speed of the core then slows down to one-half web speed as the core is rolled over the stationary plate by the upper winding roll.

While in the foregoing specification a detailed description of specific embodiments was set forth for the purpose of illustration, it will be understood that many of the details hereingiven may be varied considerably by those skilled in the art without departing from the spirit and scope of the invention.

We claim:

1. A core loading apparatus for a winder, the winder having a frame and spaced-apart first and second winding rolls mounted on the frame, comprising:

a core guide movably mounted on the frame, a core inserter rotatably mounted on the frame, and a core drive for moving an elongated core axially onto the core guide, the core guide being movable between a first position in which the core guide receives a core from the core drive and a second position in which the core guide moves the core toward the core inserter, the core inserter being rotatable between a first position in which the core inserter receives a core from the core guide and a second position in which the core inserter moves the core toward the first winding roll, the core guide comprising first and second core guide channels which are rotatably mounted on the frame, the core guide channels being spaced-apart when the core guide is in its first position whereby a core can be moved axially into the space between the core guide channels, the space between the core guide channels in the first position of the core guide being such that the core guide channels exert a frictional force on a core as the core moves axially.

2. The apparatus of claim 1 including means for rotating one of the core guide channels away from a core between the core guide channels and for moving the other core guide channel toward the core inserter.

3. A core loading apparatus for a winder, the winder having a frame and spaced-apart first and second winding rolls mounted on the frame, comprising:

a core guide movably mounted on the frame, a core inserter rotatably mounted on the frame, and a core drive for moving an elongated core axially onto the core guide, the core guide being movable between a first position in which the core guide receives a core from the core drive and a second position in which the core guide moves the core toward the core inserter, the core inserter being rotatable between a first position in which the core inserter receives a core from the core guide and a second position in which the core inserter moves the core toward the first winding roll, the core guide comprising first and second core guide channels which are rotatably mounted on the frame, the core guide channels being spaced-apart when the core guide is in its first position whereby a core can be moved axially into the space between the core guide channels, and means for rotating one of the core guide channels away from a core between the core guide channels and for moving the other core guide channel toward the core inserter, said rotating means including a first gear connected to one of the core guide channels and a second gear connected to the other core guide channel, said gears being engaged with each other.

4. A core loading apparatus for a winder, the winder having a frame and spaced-apart first and second winding rolls mounted on the frame, comprising:

a core guide movably mounted on the frame, a core inserter rotatably mounted on the frame, and a core drive for moving an elongated core axially onto the core guide, the core guide being movable between a first position in which the core guide receives a core from the core drive and a second position in which the core guide moves the core toward the core inserter, the core inserter being rotatable between a first position in which the core inserter receives a core from the core guide and a second position in which the core inserter moves the core toward the first winding roll, the core guide comprising first and second core guide channels which are rotatably mounted on the frame, the core guide channels being spaced-apart when the core guide is in its first position whereby a core can be moved axially into the space between the core guide channels, one or both of the core guide channels including a ratchet roller which rotates in only one direction and which is engageable with the core.

5. A core loading apparatus for a winder, the winder having a frame and spaced-apart first and second winding rolls mounted on the frame, comprising:

a core guide movably mounted on the frame for rotary movement about an axis, a core inserter rotatably mounted on the frame, and a core drive for moving an elongated core axially onto the core guide, the core guide being rotatable along an arc between a first position in which the core guide receives a core from the core drive and a second position in which the core guide moves the core toward the core inserter, the core inserter being rotatable between a first position in which the core inserter receives a core from the core guide and a second position in which the core inserter moves the core toward the first winding roll.

6. The apparatus of claim 5 in which said core guide is mounted on a shaft which is rotatably mounted on the frame for rotary movement about said axis, and means for rotating the shaft.

7. The apparatus of claim 5 in which the core inserter includes vacuum ports for holding a core on the core inserter.

8. The apparatus of claim 5 including a second core guide rotatably mounted on the frame for rotary movement about a second axis, the second core guide rotating counterclockwise away from the first-mentioned core guide as the first core guide rotates clockwise from its first position to its second position, the core inserter rotating clockwise from its first position to its second position.

9. The apparatus of claim 8 including a first gear connected to the first core guide and a second gear connected to the second core guide, said gears being engaged with each other so that the first and second core guides rotate in opposite directions.

10. The apparatus of claim 5 including a glue applicator for applying glue to the core as the core moves axially toward the core guide.

11. The apparatus of claim 5 in which the core drive includes core drive wheels rotatably mounted on the frame and means for rotating the core drive wheels.

12. A core loading apparatus for a winder, the winder having a frame, a first winding roll mounted on the frame, a second winding roll mounted on the frame and spaced from the first winding roll, a stationary surface mounted on the frame and spaced below the first winding roll, comprising:

a core guide movably mounted on the frame, a vacuum core inserter rotatably mounted on the frame for rotary movement about an axis, the vacuum core inserter including a vacuum port for holding a core on the core inserter, a core drive for moving an elongated core axially onto the core guide, the core guide being movable between a first position in which the core guide receives a core from the core drive and a second position in which the core guide moves the core toward the core inserter, the vacuum core inserter being rotatable to rotate the vacuum port in an arc between a first position in which the vacuum port is positioned below the stationary plate and in which the core inserter receives a core from the core guide and a second position in which the vacuum port is positioned adjacent the space between the first winding roll and the stationary plate whereby a core held by the vacuum port can be inserted into the space between the first winding roll and the stationary plate.

13. A core loading apparatus for a winder, the winder having a frame and spaced-apart first and second winding rolls mounted on the frame, comprising:

first and second core guides rotatably mounted on the frame, the first core guide being mounted for rotary movement about a first axis and the second core guide being mounted for rotary movement about a second axis, a core inserter rotatably mounted on the frame, and a core drive for moving an elongated core axially between the core guides, the first core guide being rotatable along an arc in a counterclockwise direction from a first position to a second position, the second core guide being rotatable along an arc in a clockwise direction from a first position to a second position, the core guides being spaced apart in their first positions to provide a space for receiving a core from the core drive, the first core guide moving away from the second core guide when the first core guide moves from its first position to its second position, the second core guide moving toward the core inserter when the second core guide moves from first position to its second position, the core inserter being rotatable between a first position in which the core inserter receives a core from the second core guide and a second position in which the core inserter moves the core toward the first winding roll.

14. The apparatus of claim 13 in which the first core guide is mounted on a first shaft which is rotatably mounted on the frame for rotary movement about said first axis and said second core guide is mounted on a second shaft which is rotatably mounted on the frame for rotary movement about said second axis, and means for rotating the shafts.

* * * * *